US007950457B2

(12) United States Patent
Seekford

(10) Patent No.: US 7,950,457 B2
(45) Date of Patent: May 31, 2011

(54) METHOD AND APPARATUS FOR STIMULATING WELLS WITH PROPELLANTS

(76) Inventor: Dale B. Seekford, Gloster, LA (US)

( * ) Notice: Subject to any disclaimer, the term of this patent is extended or adjusted under 35 U.S.C. 154(b) by 0 days.

(21) Appl. No.: 12/488,160

(22) Filed: Jun. 19, 2009

(65) Prior Publication Data

US 2009/0260821 A1 Oct. 22, 2009

Related U.S. Application Data

(62) Division of application No. 11/359,072, filed on Feb. 22, 2006, now Pat. No. 7,565,930.

(60) Provisional application No. 60/655,456, filed on Feb. 23, 2005.

(51) Int. Cl.
*E21B 43/263* (2006.01)

(52) U.S. Cl. ..... 166/298

(58) Field of Classification Search ..... 166/297, 166/298, 55

See application file for complete search history.

(56) References Cited

U.S. PATENT DOCUMENTS

| | | | | |
|---|---|---|---|---|
| 2,023,784 | A | | 12/1935 | Farren et al. |
| 3,313,234 | A | | 4/1967 | Mohaupt |
| 3,422,760 | A | | 1/1969 | Mohaupt |
| 4,039,030 | A | | 8/1977 | Godfrey et al. |
| 4,329,925 | A | | 5/1982 | Hane et al. |
| 4,391,337 | A | | 7/1983 | Ford et al. |
| 4,537,255 | A | | 8/1985 | Regalbuto et al. |
| 4,581,998 | A | * | 4/1986 | Horst et al. ..... 102/289 |
| 4,633,951 | A | | 1/1987 | Hill et al. |
| 4,683,943 | A | | 8/1987 | Hill et al. |
| 4,798,244 | A | | 1/1989 | Trost et al. |
| 4,976,318 | A | | 12/1990 | Mohaupt et al. |
| 5,005,641 | A | * | 4/1991 | Mohaupt ..... 166/63 |
| 5,295,545 | A | | 3/1994 | Passamaneck |
| 5,775,426 | A | | 7/1998 | Snider et al. |
| 5,894,888 | A | | 4/1999 | Wiemers et al. |
| 6,082,450 | A | | 7/2000 | Snider et al. |
| 6,138,753 | A | | 10/2000 | Mohaupt |
| 6,158,511 | A | | 12/2000 | Wesson |
| 6,336,506 | B2 | | 1/2002 | Wesson |
| 6,378,611 | B1 | | 4/2002 | Helderle |
| 6,494,261 | B1 | | 12/2002 | Pahmiyer |
| 6,497,285 | B2 | | 12/2002 | Walker |
| 6,561,274 | B1 | | 5/2003 | Hayes et al. |
| 6,755,249 | B2 | | 6/2004 | Robison et al. |
| 6,817,298 | B1 | | 11/2004 | Zharkov et al. |
| 6,865,792 | B2 | | 3/2005 | Kash |
| 6,865,978 | B2 | | 3/2005 | Kash |
| 6,926,096 | B2 | | 8/2005 | Kash |

(Continued)

OTHER PUBLICATIONS

Branagan, P.T., "Measuring the Hydraulic Fracture-Induced Deformation of Reservoirs and Adjacent Rocks Employing a Deeply Buried Inclinometer Array: GRI/DOE Mult-Site Project" SPE 36451 (Oct. 6-9, 1996).

(Continued)

*Primary Examiner* — William P Neuder
(74) *Attorney, Agent, or Firm* — Proskauer Rose LLP

(57) ABSTRACT

The present invention relates to apparatus and methods to stimulate subterranean production and injection wells, such as oil and gas wells, utilizing rocket propellants. Rapid production of high-pressure gas from controlled combustion of a propellant, during initial ignition and subsequent combustion, together with proper positioning of the energy source in relation to geologic formations, can be used to establish and maintain increased formation porosity and flow conditions with respect to the pay zone.

8 Claims, 9 Drawing Sheets

U.S. PATENT DOCUMENTS

| | | | |
|---|---|---|---|
| 2005/0109509 | A1 | 5/2005 | Snider et al. |
| 2006/0048664 | A1 | 3/2006 | Tiernan et al. |

OTHER PUBLICATIONS

Cuderman, J.F., "Multiple Fracturing Experiments—Propellant and Borehole Considerations" SPE/DOE 10845 (May 16-18, 1982).
Geertsma, J. et al., "A Rapid Method of Predicting Width and Extent of Hydraulically Induced Fractures" Journal of Petroleum Technology (Dec. 1969).
Schatz, J.F. et al., "High-Speed Downhole Memory Recorder and Software Used to Design and Confirm Perforating/Propellant Behavior and Formation Fracturing" SPE 56434 (Oct. 3-6, 1999).
van Batenburg, D. et al., "New Techniques for Hydraulic Fracturing in the Hassi Messaoud Field" SPE 63104 (Oct. 1-4, 2000).
Warpinski, N. R. et al., "An Interpretation of M-Site Hydraulic Fracture Diagnostic Results" SPE 39950 (Apr. 5-8, 1998).
International Search Report for PCT/US2006/06344, mailed Sep. 27, 2006.

* cited by examiner

Top View

METHOD AND APPARATUS FOR STIMULATING WELLS WITH PROPELLANTS

RELATED APPLICATIONS

This application is a divisional application of U.S. Ser. No. 11/359,072, filed on Feb. 22, 2006, the entire contents of which are incorporated herein by reference. This application claims priority to and benefit of U.S. Ser. No. 60/655,456, filed Feb. 23, 2005, the contents of which are incorporated herein by reference.

FIELD OF THE INVENTION

The present invention relates to apparatus and methods to stimulate subterranean wells, including injection or production wells, utilizing rocket propellants. Wells such as oil and gas production wells can be stimulated to enhance oil or gas production.

BACKGROUND

Early attempts to increase fluid flow area around the wellbore of a subterranean production well, such as an oil and/or gas production well, used devices and materials such as nitroglycerin, dynamite, or other such high energy materials to produce an explosive event that would create flow area at desired locations. These early methods had only limited success. A presentation of Cuderman's work at the Society of Petroleum Engineers (SPE) conference in Pittsburgh, Pa. on May 16-18, 1982, confirmed the existence of a preferred multiple fracture regime under certain firing conditions. Cuderman demonstrated that pressure rise time was an important factor for increasing near wellbore permeability. FIG. 1 illustrates the findings of Cuderman in chart form. Cuderman described three fracture regimes of underground formations. Based on this information, other technologies were developed.

More specifically, Cuderman demonstrated the existence of a hydraulic fracture regime, an explosive fracture regime, and an intermediate multiple fracture regime (see SPE/DOE 10845, "Multiple Fracturing Experiment-Propellant in Borehole Considerations" by Jerry F. Cuderman). The hydraulic fracture regime is characterized by a slow pressure rise that occurs when fluid flows to the point of least resistance. To create formation characteristics in the multiple fracture regime, a more rapid pressure rise is required. Pressure developed in the hydraulic fracture regime flows to the point of least resistance, usually generating a bidirectional, two-dimensional fracture. In contrast, the explosive fracture regime is created when a very rapid pressure rise of short duration is produced. Frequently, the explosive fracture regime causes formation damage and rubblization, damaging and sealing off some of the pore space. This results in an undesirable loss of porosity.

A number of inventors have attempted to use propellants in wells to achieve various goals; some of these are listed below in Table 1.

TABLE 1

| Inventor | Patent No. | Issue Date |
|---|---|---|
| Snider et al. | 5,775,426 | Jul. 7, 1998 |
| Passamaneck | 5,295,545 | Mar. 22, 1949 |
| Hill et al. | 4,683,943 | Aug. 4, 1987 |

TABLE 1-continued

| Inventor | Patent No. | Issue Date |
|---|---|---|
| Hill et al. | 4,633,951 | Jan. 6, 1987 |
| Ford et al. | 4,391,337 | Jul. 5, 1983 |
| Hane et al. | 4,329,925 | May 18, 1982 |
| Godfrey et al. | 4,039,030 | Aug. 2, 1977 |
| Mohaupt | 3,313,234 | Jan. 13, 1958 |

Each of these techniques has issues with wellbore conditions, explosive propellants, and/or minimal effective stimulation due to lack of or loss of energy.

Snider '426 describes a method of surrounding at least one perforating shaped charge with a sleeve of propellant, and uses the perforating charge blow a hole through the propellant and ignite it. The propellant gas is then used to create fractures in the near wellbore. A system is used that utilizes a shaped charge, or many shaped charges, to ignite the propellant sleeve. This type of ignition makes it difficult to predictably reproduce the event. Shaped charges are configured to blow through pipe and cement, thereby creating a tunnel for fluid flow. The entry hole size varies widely, e.g., from 0.19" to 1.10" and from 1 shot per foot up to 18 shots per foot (or more). This does not allow for a predictable, consistent amount of propellant surface area to be ignited. The propellant of Snider is broken into a random number of pieces, resulting in unpredictable pressure rise and propellant flow results.

Passamaneck '545 describes a method of externally igniting an external portion of a propellant charge to burn inwardly, thus yielding a more predictable ignition of the external propellant surface. Although the ignition system is predictable, the fluid in the wellbore keeps the propellant from reaching the critical pressure rise time needed to achieve a multiple fracture regime because of fluid leaching into the propellant. Much of the energy required for formation treatment is lost to the well fluid that inhibits the burn.

Hill '943 and '951 uses a compressible fracturing fluid to carry the propant into the fractures, causing hydraulic fracturing due to the energy stored in the "compressible" fluid.

Ford '337 describes positioning propellant having an abrasive material directly adjacent a shaped charge that is subsequently ignited. The shaped charge ignites the propellant gas and propels the abrasive material, thereby enlarging the perforation holes and extending fractures. The extended fractures are propped open by the abrasive material.

Hane '925 describes a method of utilizing multiple explosive charges in an effort to rubblize and fracture the formation.

Godfrey '030 describes a method of igniting a propellant tens of feet above a high explosive disposed adjacent to the pay zone, with the high explosive and the propellant being suspended in fracturing fluid. Godfrey's technique attempts to extend the duration of the shock wave caused by the high explosive.

Mohaupt '234 describes a method of igniting a propellant-type explosive that is dispersed into the wellbore liquid. This allows it to be ignited and reignited to cause pressure oscillations.

Subterranean wells often have a restricted flow area near the wellbore. Examples of such wells can include oil and/or gas producing wells, injection wells, storage wells, brine or water production wells, and disposal wells. The restricted flow area can be caused by the overburden exerting excessive compression on the formation near the wellbore, or by man-made damage near the wellbore, e.g., during drilling operations. For example, fluids or materials introduced into the wellbore can restrict permeability, reducing fluid communication and decreasing flow capacity to the pay zone. Certain wells have pay zones that cannot be effectively produced without some type of stimulation. Such wells are usually "tight" and require that additional flow area be opened to enable the wells to become commercially viable.

The technologies described in the documents above each attempt to create multiple fractures near the wellbore or open fractures near the wellbore prior to a hydraulic fracture, thereby increasing formation permeability and enhanced flow characteristics near the wellbore. Unfortunately, they each possess certain limitations. For example, none of them utilize a predictable internal ignition system to enable them to reach a critical pressure rise time necessary to enter into the multiple fracture regime and to provide sufficient gas volume to be able to extend the multiple fractures sufficiently far into the formation while protecting the propellant from the fluid in the wellbore.

What is needed is a method and apparatus utilizing an internal ignition in combination with a propellant charge that creates fractures into the wellbore in the multiple fracture regime, and extends these fractures further into the subterranean formation, thereby providing for an extended radial flow area that enhances well capacity and production capabilities.

SUMMARY OF THE INVENTION

The present invention achieves these objectives by using an internal propellant ignition system that is predictable and repeatable, in combination with a propellant that has the characteristics needed to enable the multiple fracture regime to be reached and extended. The propellant uses a long burn time in combination with a predetermined pressure rise time to provide the energy needed to create and/or extend the fractures.

The present invention also creates multiple fractures in the multiple fracture zone and extends them further into the formation. This is achieved using an enhanced (rapid) critical pressure rise time and sufficient peak pressure, in combination with the extended propellant burn time. After the fractures are initiated, they can be extended into the formation by gas that is still being generated by the propellant.

One aspect of the invention includes a propellant unit for underground submersion and combustion in a production or injection well. The propellant unit includes a propellant charge defining a bore and a pre-stressed tube within the bore. A detonating member, such as a detonating cord, is within the pre-stressed tube. In some embodiments, the detonating member includes a detonating cord with a bidirectional booster at an end of the detonating cord.

At least one of a first and second end of the pre-stressed tube can be sealed to prevent liquid penetration. This sealing can be by O-rings, a tubing fitting connection, threading (e.g., NPT connections), or combinations of these or other techniques. The pre-stressed tube can be stressed by scoring along a length of an exterior surface of the tube. The scoring can be accomplished by creating a groove along the outside surface of the tube, although other techniques can be used if they weaken the pressure containing capability of the tube appropriately. Since the pre-stressing determines the high-pressure failure point(s) of the tube, multiple scores result in multiple tube ruptures, which in turn results in a corresponding number of splits in the propellant charge that surrounds the tube.

Another aspect of the invention features an explosive transfer cap for transferring an ignition from an upper propellant firing train to a lower propellant firing train within a producing or injection well. The explosive transfer cap includes a housing that has a first seal, a second seal, and a longitudinal axis extending therethrough. An explosive charge is between the first and second seals, to facilitate ignition along the longitudinal axis. Although the propellant units are referred to as "upper" and "lower", other configurations can also be used. For example, horizontal and sloped arrangements work effectively with all aspects of the invention.

The explosive charge of the explosive transfer cap can be a shaped charge. A shaped charge is especially effective at penetrating a solid seal, such as a bulkhead. Moreover, the explosive charge can be configured to be ignited by a detonator. Ignition from the detonator can reach the explosive charge, e.g., by a detonating member that includes a detonating cord and one or more bidirectional boosters. Ignition of the detonator can be performed electrically or mechanically.

In some embodiments, the first and second seal of the explosive transfer cap can be aligned along a longitudinal axis of the explosive transfer cap, and the explosive charge can facilitate ignition along this longitudinal axis. The first and/or the second seal can be a double seal, e.g., including two sealing mechanisms such as threading (e.g., NPT), tubing connections, O-rings, pressure connections, clamped connections, flanges, and others known to those of skill in the art. In some embodiments the second seal is a plug. The explosive charge of the explosive transfer cap can be configured to penetrate this plug, thereby propagating the ignition to a downstream firing train.

Another aspect of the invention is a propellant igniter for positioning within a propellant charge. This propellant igniter is configured to ignite a propellant charge and includes a pre-stressed tube and a detonating member within the tube. The detonating member extends substantially from a first end to a second end of the tube. Preferably, a length of the detonating member approximately corresponds to a length of the pre-stressed tube. The scoring of the pre-stressed tube can include establishing one or more shallow grooves along the length of the steel tubing. This can occur a number of times, with the one or more scorings distributed about a perimeter of the tube. Preferably, when more than one scoring is used, they are distributed equidistant about the perimeter of the tube. The igniter can be sealed at one or both ends to protect the detonating member from contaminants.

Yet another aspect of the invention features a carrier connector for a stimulation gun. The carrier connector includes a carrier housing, which includes a first end and a second end defining a longitudinal axis therethrough. The first end is adapted for connection with a first propellant carrier and the second end adapted for connection with a second propellant carrier. The carrier connector includes a first seal adjacent the first end and a second seal adjacent the second end. The connector is adapted to accommodate an explosive charge between the first seal and the second seal, which is configured to transfer an ignition along the longitudinal axis. The explosive charge, such as a shaped charge, can be configured to perforate the second seal, especially in embodiments where the second seal is a bulkhead plug. Moreover, the carrier connector can include a detonating member disposed within a longitudinal bore defined by the first end and the second end.

Another aspect of the invention features a propellant carrier unit for use in stimulating a producing or injection well. The carrier unit includes a first propellant unit and a second propellant unit. Each propellant unit can include a propellant charge defining a bore, a pre-stressed tube within the bore, and a detonating member within the pre-stressed tube. An explosive transfer cap is disposed between the first propellant unit and the second propellant unit for passing an ignition from the first propellant unit to the second propellant unit. Embodiments include the first propellant unit being configured to be ignited by a detonator.

Another aspect of the invention includes a method for stimulating a producing or injection well that comprises the steps of providing a propellant unit comprising a propellant charge, pre-stressing a tube within the propellant unit to facilitate establishment of a desired initial pressure release, igniting the propellant unit, splitting the propellant charge to form a predetermined, predictable amount of propellant surface area, and generating a gas pressure within an interior of a well bore of the production or injection well. The propellant unit can include a bore defined by the propellant charge, such that at least a portion of the pre-stressed tube disposed within the bore, and a detonating member within the pre-stressed tube. The detonating member can extend substantially from a first end to a second end of the pre-stressed tube. The propellant unit can be configured to be ignited by a detonator.

Yet another aspect of the invention features a method of transferring an ignition from a first propellant unit to a second propellant unit within a producing or injection well. This method includes the steps of connecting a first propellant unit to a first end of an explosive transfer cap, connecting a second propellant unit to a second end of the explosive transfer cap, igniting a first detonating member of the first propellant unit, transferring the ignition from the first detonating member to an explosive charge within the explosive transfer cap, and transferring the ignition from the explosive charge within the explosive transfer cap to the second detonating member. The detonating member can be a detonating cord, or it can include a detonating cord and at least one bidirectional booster. Ignition of the first detonating member can be by a detonator.

Another aspect of the invention features a method of transferring an ignition from a first carrier unit to a second carrier unit within a producing or injection well. This method includes the steps of connecting a first carrier unit to a first end of a carrier connector, connecting a second carrier unit to a second end of the carrier connector, igniting a propellant igniter of the first carrier unit, transferring the ignition from the first carrier unit to an explosive charge disposed within the carrier connector, and transferring the ignition from the explosive charge within the carrier connector through a bulkhead to a propellant igniter of the second carrier unit. The explosive charge can be a shaped charge that propagates the ignition along a longitudinal axis of the carrier connector.

Yet another aspect of the invention features a method of controlling stimulation gas flow to a producing or injection well. This includes the steps of sizing a propellant charge of a propellant unit to correspond to a total desired stimulating gas volume or amount to be generated, igniting the propellant charge within the well using a detonating member disposed within the propellant unit, and splitting the propellant a number of times corresponding to the amount of initial gas pressure to be established. Preferably, the splitting of the propellant charge is along a longitudinal axis of the propellant charge. This can result in a plurality of substantially symmetrical propellant charge fragments, to effectively achieve a predetermined combustion gas generation rate.

An aspect of the invention features a fluid-repellant propellant material produced by the process of treating a propellant surface with a primer coating that can include rubber, fluoroelastomer, and titanium dioxide, and coating the treated propellant with a protective fluoroelastomer coating that can include fluoroelastomer, mica, and graphite, and allowing the treated propellant to dry. Yet another aspect of the invention includes a fluid-repellant propellant material comprising a propellant treated with a primer that includes rubber and fluoroelastomer, and a fluoroelastomer coating adhered to the primer coating on the propellant, the fluoroelastomer coating including fluoroelastomer and mica powder.

SUMMARY OF THE FIGURES

The foregoing discussion will be understood more readily from the following detailed description of the invention, when taken in conjunction with the accompanying drawings, in which.

DETAILED DESCRIPTION

Figure 1:
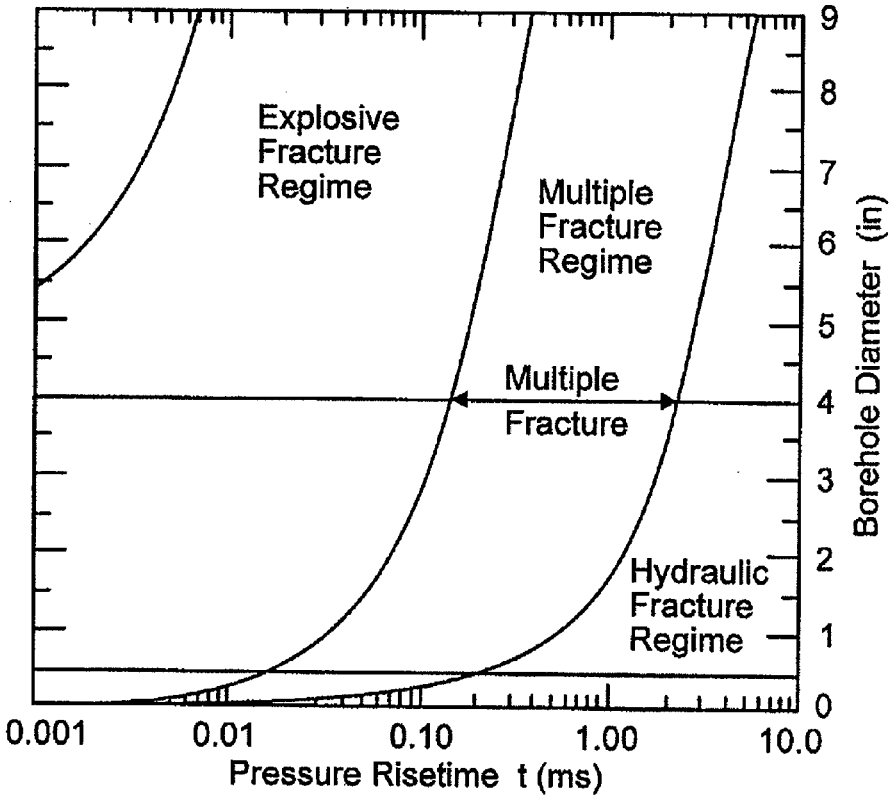
PRIOR ART FIG. 1
FIG. 1 illustrates the different fracture regimes in relation to pressure rise time and borehole diameter Cuderman discussed.
Figure 2:
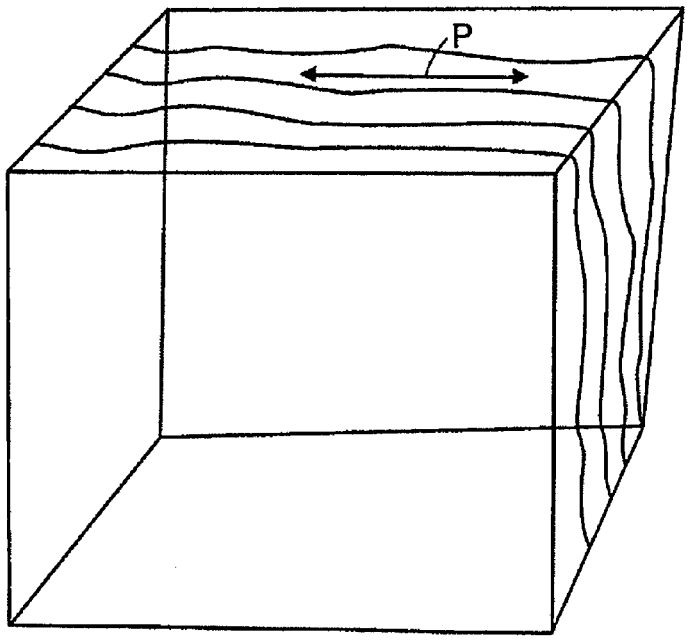
FIG. 2 illustrates the preferred fracture plane.

The invention relates to apparatus and methods to stimulate subterranean wells, including injection or production wells, utilizing rocket propellants. Wells such as oil and gas production wells can be stimulated to enhance oil or gas production. Although the following discussion focuses on oil production wells, the technology is also applicable to gas production wells, injection wells, storage wells, brine or water production wells, disposal wells, and the like. Known stimulation techniques can include multiple fracturing and/or cleaning near the wellbore to reduce flow interference that can be caused by debris. As described above, hydraulic fracturing processes create fluid (e.g., gas and/or liquid) communication by fracturing the rock with hydraulic pressure. A propping material can also be used, such as sand, bauxite, or other materials which are designed to keep the fracture open to an extensive area of the pay zone. But hydraulic fracturing is not efficient or practicable in some instances, e.g., when the point of least resistance in a producing oil well is in the direction of a salt water zone. FIG. 2 is a simplified drawing illustrating a preferred fracture plane P of a geologic formation. This is the direction that is the weakest and offers the least resistance to a fracture. This is also the direction that, if present, the natural fractures in the rock will follow, e.g., during hydraulic fracturing.

Figure 3:
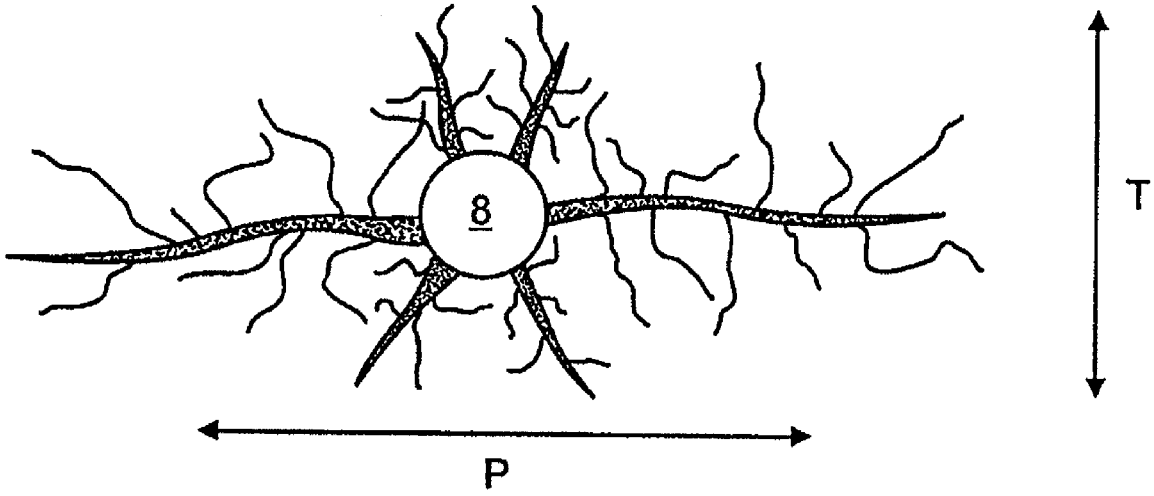
FIG. 3 is a top view illustrating multiple fractures in a pay zone.

In situations such as these, treatment in the multiple fracture regime is preferred for increasing near wellbore permeability and flow. Creation of a multiple fracture regime requires a pressure rise time that is rapid enough to exceed the ability of the preferred fracture plane to accept the gas being generated. The fractures P cannot open rapidly enough to receive the generated gas. Since the preferred fracture plane P is not able to accommodate all of the generated combustion product, additional fractures open in a direction T perpendicular to the preferred fracture plane (e.g., away from the salt water zone), thus causing an increased flow area near the wellbore. As illustrated in FIG. 3, multiple fractures oriented in a generally transverse direction T result when the pressure and pressure rise time of the invention is achieved. Many of these multiple fractures are formed that are transverse to the natural, geologic preferred fracture plane P of the formation. In addition to forming transverse fractures, additional fractures paralleling the preferred fracture plane P can stem from the newly-created transverse fractures. Although the longer fractures tend to parallel the preferred fracture plane, the shorter transverse fractures tend to break off from the longer fractures as the longer fractures grow. This can result in increased near wellbore porosity without extending the permeable flow area to an undesirable (e.g., salt water) zone. Known well treatment techniques (e.g., hydraulic fracturing and devices entering the explosive fracture regime) are unable to achieve results such as these.

As can be seen from the figures, the propellant treatment techniques described herein can be used to increase well production with minimal risk of propagating the flow area out of the pay zone (e.g., into an undesired adjacent salt water zone). Although the propellant treatment time can be as long as 2,000 milliseconds, this amount of time is insufficient for the fracture to propagate out of the pay zone. The present invention can be used to initiate fractures prior to a hydraulic fracture. The risk of near wellbore damage (e.g., rubblization) can be minimized since the propellant treatment reduces the initial breakdown pressure encountered during any subsequent hydraulic fracturing process. In some embodiments, when the invention is used to create a sufficient number of fractures near the wellbore, a hydraulic fracture treatment may not be required.

Figure 4:
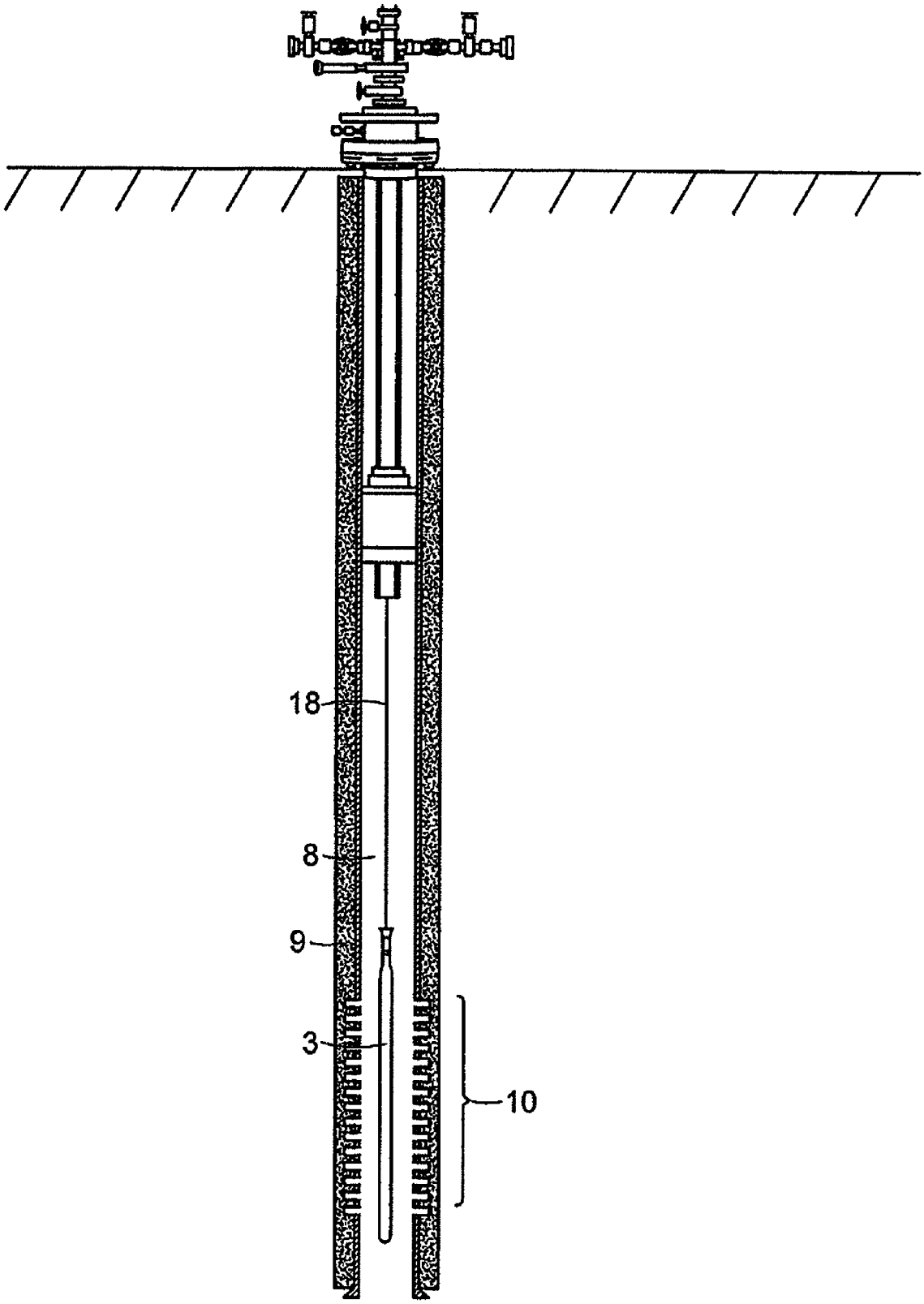
FIG. 4 illustrates a typical propellant treatment via wireline where the propellant is set adjacent to the perforations in a pay zone.

FIG. 4 illustrates propellant treatment via wireline where the propellant is set adjacent to the perforations in a pay zone. This diagram represents a typical configuration for a propellant 3. In this scenario the propellant is deployed into the hole 9 via wireline or slick line, and ignited adjacent to the pay zone 10 in the wellbore 8.

Although propellant fracturing for well development has been used in the past, known techniques have employed only short event times (on the order of 20 to 40 milliseconds). Others have been known to have a long burn time (on the order of 500-1,000 milliseconds or longer) but have trouble reaching the critical pressure rise time required to initiate the multiple fractures that are formed during the multiple fracture regime. The present invention uses a critical pressure rise time of about 0.5 to 20 milliseconds, or preferably about 10 milliseconds, thereby generating sufficient peak pressure to create the multiple fractures in the multiple fracture regime. The invention also extends these treatments, e.g., to about 500 to 2000 milliseconds, or preferably to about 500 milliseconds, thereby extending, the multiple fractures further into the formation. As described below, embodiments of the invention achieve this by controlling both the initial pressure rise and the entire burn duration of the propellant.

Embodiments of the present invention utilize the propellant gas for clean up of the near wellbore (e.g., to increase local wellbore porosity) and for fracturing. Predictable stimulation and protection from wellbore fluids results, and sufficient energy for effective stimulation is provided. As described below, embodiments include utilizing an internal linear ignition system to split the propellant into two or more pieces of predicable size (see FIG. 5), allowing for large, predictable amounts of surface area to be ignited in a dry environment (i.e., absent the effect of the well fluids). Some well treatments require larger gas production amounts, which can be achieved with the larger propellant ignition surface area provided by the invention. This can be achieved by splitting the propellant into more pieces.

A propellant unit of the invention includes a detonating member 1, such as a detonating cord, explosive cord, deflagrating cord, detonating fuse, explosive fuse, and the like, disposed, e.g., in a pre-stressed steel tube. For convenience, these are each referred to as a detonating cord, herein. A detonating cord is defined as an elongated charge with sufficient energy to split a scored tube 2 when ignited inside the tube. The term detonating member includes one or more detonating cords as defined herein. In a preferred embodiment, the detonating member 1 includes a detonating cord having a bidirectional booster at one or both ends. Generally, a bidirectional booster is similar to a detonating cord except that it has a higher energy content (e.g., due to compression of the explosive material). As used herein, the term bidirectional booster also includes many types of boosters, such as omnidirectional boosters, unidirectional boosters, lead azide technology, and others.

Figure 5:
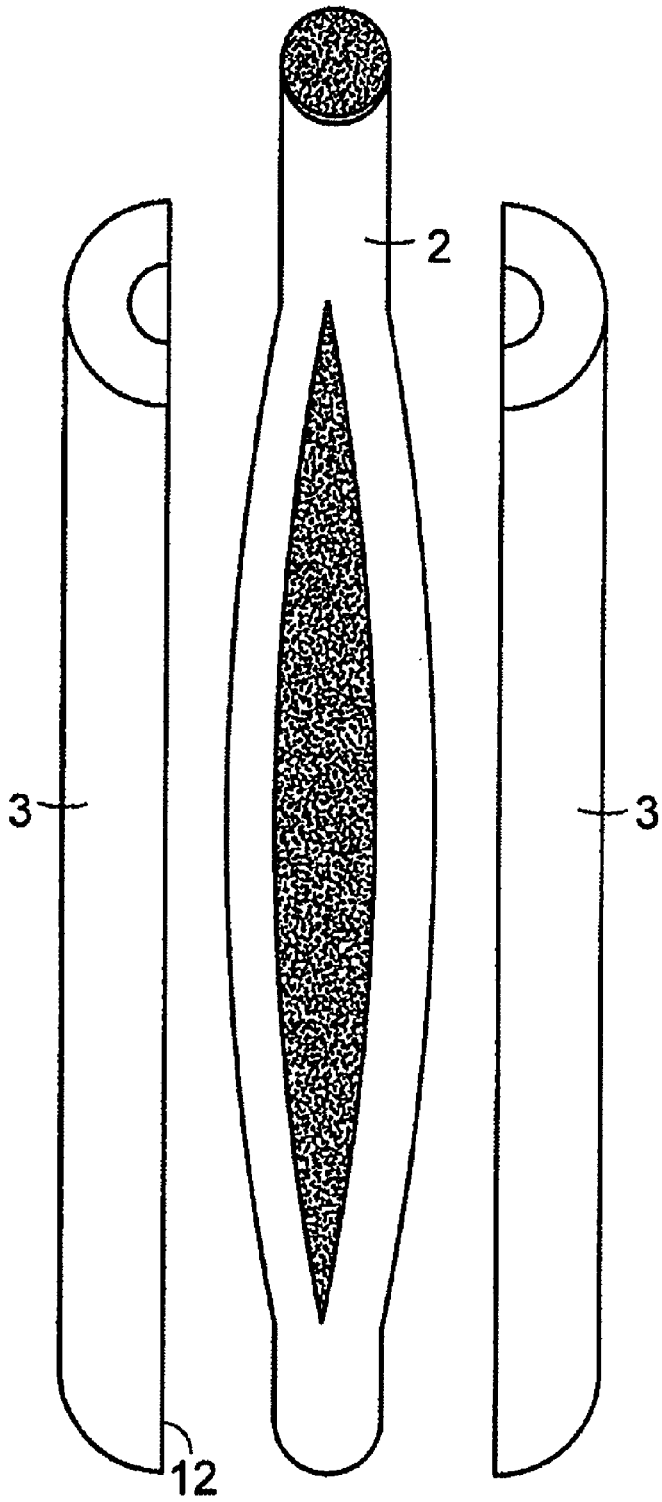
FIG. 5 illustrates a steel tube and propellant being split by the energy from a detonating member, when the tube is scored on opposite sides, 180 degrees apart.

The tube 2 can be ⅜" diameter stainless steel tubing and is located in the propellant charge 3. Although the pre-stressed member is referred to herein as a tube 2, embodiments can include other configurations, such as an oval shape, a flared shape, an irregular shape, a square channel member, and others. The term "tube" is also intended to include combinations of different shapes, such as non-circular cross-sections disposed between circular (cylindrical) end portions. The tube 2 can also be other sizes and can be made of other materials possessing suitable physical characteristics. FIG. 5 illustrates how the steel tube 2 can be split upon ignition of the detonating member 1, and how the energy splits and ignites the propellant 3 into predictable sizes without distorting the propellant 3. Preferably, the steel tube 2 is not split to the end of the tube. The tube 2 can be scored multiple times, to increase the number of longitudinal splits in the propellant 3 when the detonating member 1 is ignited. This can be used to control the initial burn rate of the propellant charge. These multiple splits result in increased propellant surface area, which then cause a more rapid rise in initial pressure when the propellant is ignited. Nonetheless, combustion of the propellant is a controlled burn, not an explosion. The number of scores 12 (grooves) on the tube can be customized to a particular well stimulation application based on formation geology and characteristics, to achieve the type of stimulating results desired (e.g., multiple fracture regime stimulating results). Moreover, as described in more detail below, the detonating member 1 can be sealed within the tube 2 to keep it isolated from well fluids as the propellant unit is placed in the well. Such sealing and isolation from well fluids results in a reliable, predictable ignition system.

Figure 6:
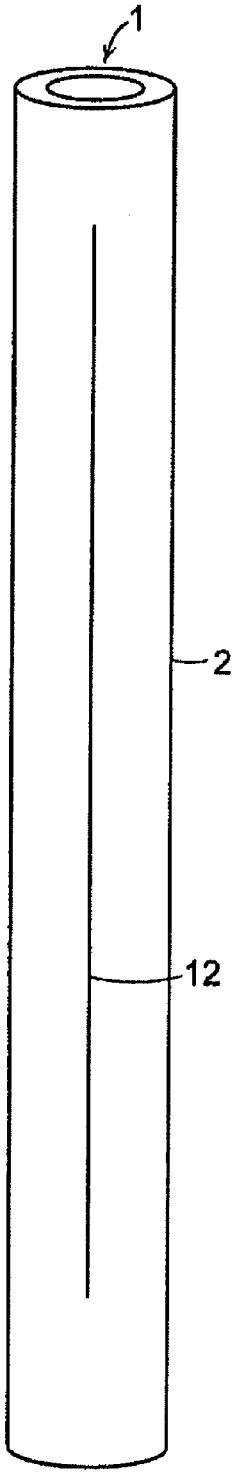
FIG. 6 illustrates a steel tube with one cut or stressed point. If a two way split of the propellant is desired another cut could be located 180 degrees around the tube, across from the first groove.

FIG. 6 illustrates scoring of a steel tube 2. The tube 2 can be scored with two or more cuts or grooves 12 to weaken it at precise points (although only one score is illustrated). Shown is one side cut to make a weak point without allowing the steel tube 2 to be broken or leak. These weak points or cuts or grooves 12 allow the energy from the detonating member 1 to split the steel tube 2 and the propellant 3 at this point, igniting the propellant 3 into predictable sizes containing predetermined amounts of energy. The cuts or grooves 12 can extend along the full length of the propellant 3, while still allowing sufficient tubing material on each end to maintain the steel tube 2 in one piece even after the propellant has been consumed. The scoring along the length of the tube 2 can be, e.g., 2 feet long, 5 feet, or 6 feet, and is preferably about the length of the propellant. The depth of the scoring can be about 0.010 inches deep, and can range from about 0.005 to about 0.020 inches deep.

This figure illustrates a propellant igniter of the invention. A pre-stressed tube 2 comprising a detonating member 1 extending substantially from one end to the other end of the tube can be used to ignite a propellant charge. Preferably, the tube is scored one or more times corresponding to an initial amount of gas release and pressure rise that is desired to initially stimulate a well. The scoring can include external cutting or grooving of the tube, although other techniques to weaken the tube at specified positions can be used. If multiple scoring techniques are used, preferably the scores are distributed about a circumference of the tube. For example, two scores should be oriented at 180 degrees, 3 scores at 120 degrees, etc. When the igniter is positioned in the well it is not important that the scores be positioned along a desired fracture direction. The orientation of the scores has little, if any effect since the propellant igniter, as discussed below, is generally mounted within a carrier. As discussed below, the ends of the propellant igniter can be, e.g., sealed or double sealed, to increase repeatability and firing reliability.

Figure 7:
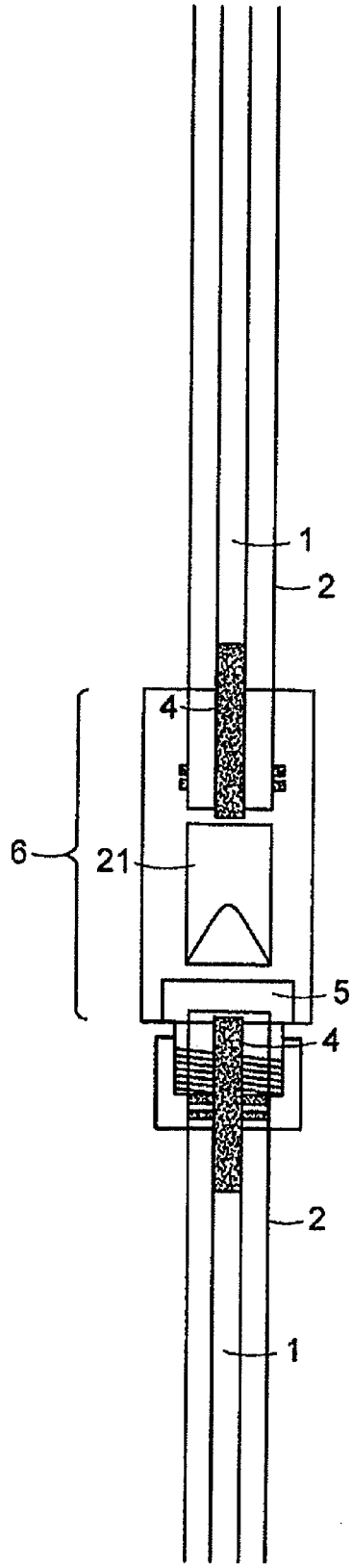
FIG. 7 illustrates a portion of the firing train including an explosive transfer cap.

Another embodiment of the invention includes an explosive transfer cap disposed between propellant units, for transferring ignition from one propellant unit to another. FIG. 7 illustrates a portion of the firing train. The detonating member 1 is used to split the tube 2 in which it is housed, and splits and ignites the propellant 3. The tube 2 houses the detonating member 1 and isolates it from the wellbore fluid 8 and/or gases 8. As illustrated, two or more sides of the tube are grooved, e.g., with approximately 0.010" deep grooves 12 (see FIG. 6) to cause the tube to split at the grooves so energy from the detonating member 1 will split the tube and ignite and split the propellant into predetermined sizes and shapes. If the central portion of the detonating member is a detonating cord, then a bi-directional booster 4 can be positioned at one or both ends of the detonating cord. Bi-directional boosters are more easily ignited than a detonating cord and can be used to facilitate transfer of the ignition. As illustrated in FIG. 7, placing this arrangement can facilitate transfer of the ignition between the firing trains (e.g., from a first to a second propellant unit).

Figure 8:
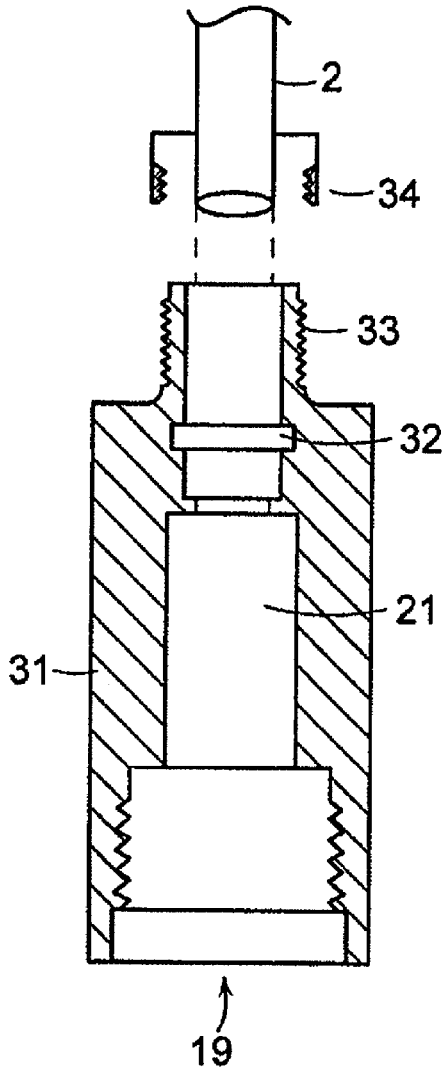
FIG. 8 illustrates an embodiment of a housing for an explosive transfer cap.
Figure 9:
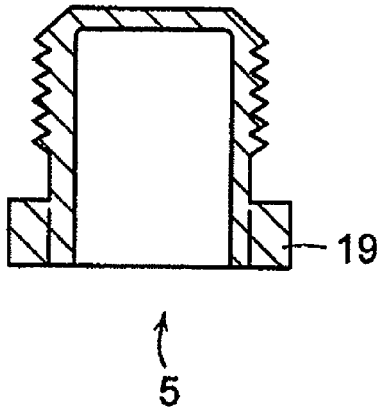
FIG. 9 illustrates a bulkhead for insertion in one end of an explosive transfer cap.
Figure 10:
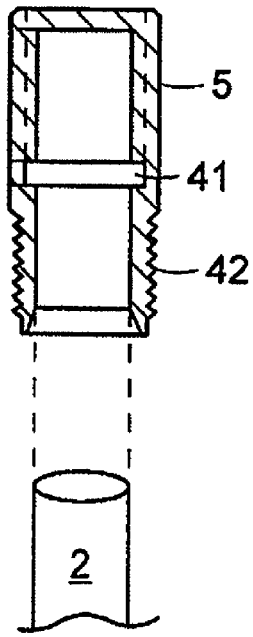
FIG. 10 illustrates a top end cap (receptor) for sealing a first end of a propellant firing train.

A combination sealed end cap (bulkhead) and a custom perforating charge 21 can also be used in the explosive transfer cap 6. The explosive transfer cap 6 can be manufactured to include or house an explosive charge 21, such as a shaped charge. Preferably, about 1 to 1½ grams of explosives are used, to enable penetration of, e.g., 1" steel with a minimum 0.20" entry hole. A sealed bulkhead 19 can be placed at the end of the explosive charge 21 to protect it from the well environment. The other end of the propellant unit firing train can be sealed and protected by a top end cap (also known as a receptor 5). Thus, a propellant unit firing train can be configured as a sealed unit extending from a top end cap 5 at one end, along the steel tube 2, and extending to an explosive transfer cap 6 at the other end. An explosive charge 21 in the explosive transfer cap can be sealed by the bulkhead 19. FIGS. 8, 9, and 10 illustrate an embodiment of a housing 31 for an explosive transfer cap 6, a bulkhead 19, and a receptor 5, respectively. As can be seen from FIG. 8, in this embodiment a tube 2 of a propellant firing train can be threaded 33 to the housing 31 with a tubing fitting 34 and the connection can also be sealed with an O-ring 32, thereby forming a double seal against, e.g., liquid penetration. The tubing fitting portion of the arrangement can use conventional ferule technology (ferule not shown). The bulkhead 19 of FIG. 9 can be threaded into the housing 31 of FIG. 8. Finally, the receptor 5 of FIG. 10, representing a first end of the firing train of the next propellant unit, can be inserted against the bulkhead 19. As illustrated, the receptor end of the tube is also double sealed, including an internal O-ring 41 and an external threaded connection 42 to which the tube 2 can be threaded, e.g., with a common tubing fitting as described above. Other techniques will become apparent to the skilled artisan based on this description, which can also be used. For example, other connection types can be used such as threading (e.g., NPT), various types of tubing connections (single ferule, double ferule, integral ferule, and the like), various O-ring configurations, pressure connections, clamped connections, flanges, and others techniques known to those of skill in the art. These sealing techniques allow the detonating member to remain dry when the propellant unit is submerged into a liquid environment for subsequent combustion. They also allow discrete sealed units to be assembled at a shop, before being transported to a work site. Embodiments include using only single seals, although double sealing is preferred. Maintaining the firing train in a clean and dry state enhances the reliability of the system.

During fabrication, when the receptor 5 and the explosive transfer cap 6 are installed on a tube 2, the assembly is pressure tested to ensure there are no leaks. The propellant is then placed over the top end cap 5 and can butt against the explosive transfer cap 6. It will be understood that using this technique each propellant unit can be sealed at the top and bottom to prevent fluid penetration into the firing train, and to maintain a clean firing system during transport to a well site.

Figure 11:
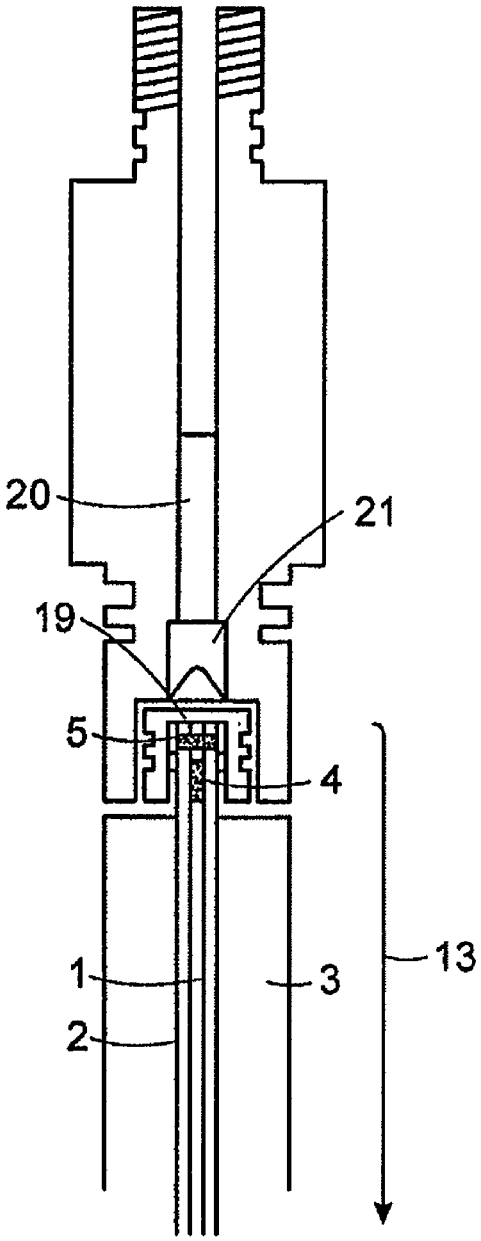
FIG. 11 illustrates the firing train for a first propellant unit.

FIG. 11 illustrates the initiation of a firing train 14 on the upper most propellant unit 13. A detonator 20 can be ignited by an electrical charge, e.g., from a wireline, or mechanically, using techniques known to those of skill in the art. The ignition energy then propagates into the explosive charge 21 (e.g., a shaped charge), which fires through a bulkhead 19, and through the top end cap 5, into the detonating member 1 of the first propellant unit 13, which can include a bi-directional booster 4 at a first end of the detonating member. Ignition of the detonating member 1 splits the steel tube 2 and the propellant 3, igniting the propellant 3 and the explosive transfer cap 6 at the other end of the propellant unit 13 (not shown), which then fires through its own bulkhead 19, through the next receptor 5, and so on, through to the final propellant unit.

Thus it will be understood that the first propellant unit 13 in the firing train 14 is ignited by a shaped charge that fires through a bulk head 19, and then through the top end cap 5 of the first propellant unit (see FIG. 11). This ignites the detonating member (which can include a bi-directional booster and a detonating cord), which splits the tube and ignites the following explosive transfer cap 6. Ignition of the explosive transfer cap propagates the ignition through the adjacent bulkhead 19 and the top end cap (receptor) 5 of the following propellant unit, thereby to the firing train of the next propellant unit, in this manner continuing the firing sequence along the length of the entire firing train, through to the final propellant unit.

Figure 12:
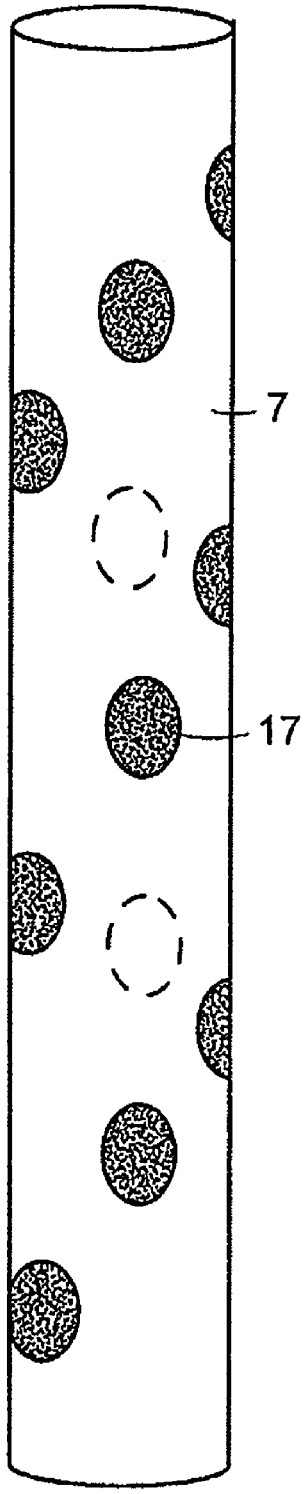
FIG. 12 illustrates a propellant carrier.

FIG. 12 illustrates a propellant carrier. The steel carrier housing 7 houses propellant units and protects them from stress and from contact with tooling in the hole. The carrier also protects the propellant units from abrasive contact with the casing or tubing wall, and provides strength to the propellant assembly. Sufficient open area 17 is cut into the carrier housing 7 to allow the gas produced by combustion of the propellant to vent from the carrier without creating excessive pressure drop across the carrier to cause damage to the carrier housing 7. One or more propellant units can be placed into a carrier 7. These propellant units can be connected using explosive transfer caps 6.

Figure 13:
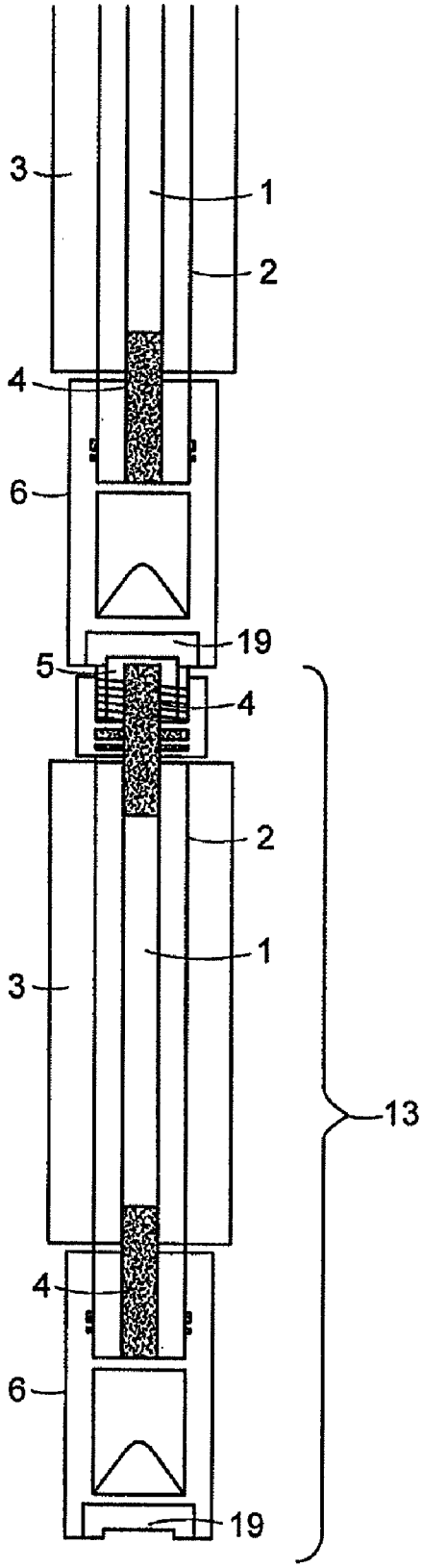
FIG. 13 illustrates a complete propellant unit.

FIG. 13 illustrates an entire propellant unit 13, including an explosive transfer cap 6. Preferably, the energy content of the propellant 3 is about 1,700 calories per $cm^3$ or more. Propellants use a combustion index as a measure of stability. The combustion index of propellant 3 should be not higher than 0.45. As defined in a Strand Burner test, the propellant should have a knee that will occur no lower than 8,000 psi. For comparison, Tovite (a TNT Substitute) has an energy content of approximately 1,100 calories per $cm^3$. A combustion index of approximately 1 represents a pure explosive. The propellant 3 can have a combustion index of about 0.45, which is comparatively stable, and will not result in an explosive event at the high pressures encountered in wellbore conditions.

Figure 14:
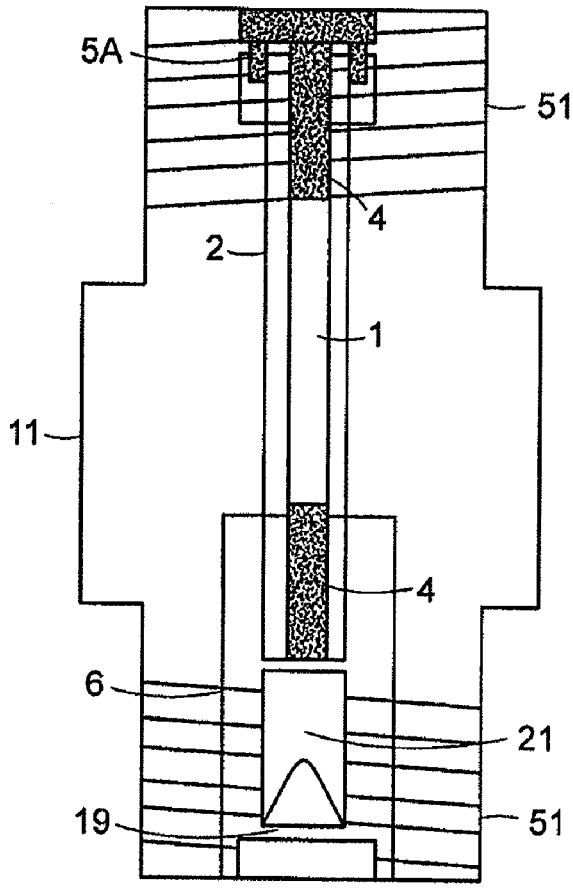
FIG. 14 illustrates a propellant carrier connector.

FIG. 14 illustrates an embodiment of a propellant carrier connector 11. Multiple carriers 7 can be assembled together into "a single run" using carrier connectors 11. Each end of the carriers 7 can have female threads. Thus, two or more carriers can be connected together using a male threaded 51 carrier connector illustrated in FIG. 15. Various connection techniques can be used, including but not limited to threading (e.g., NPT), tubing connections, O-rings, pressure connections, clamped connections, flanges, and others known to those of skill in the art.

Near one end of the connector 11 is a sealed top end cap 5A of the carrier connector. The carrier connector can also include a detonating member 1 (e.g., including bi-directional boosters 4 and a detonating cord), a tube 2 (e.g., without scoring), and an explosive charge 21 (e.g., a shaped charge). This connector allows longer carrier assemblies (e.g., up to 500 feet in overall combined length) to be run down a well in a single run without compromising the firing train. The explosive charge 21 can be configured as it was for an explosive transfer cap 6 (described above). An explosive charge 21 (not shown) from an upstream propellant unit fires through a bulkhead 19 and/or top end cap 5A in the carrier connector. The detonating member (e.g., bi-directional booster 4 and detonating cord) is ignited, the detonating member 1 ignites the explosive charge 21, which continues the ignition through bulkhead 19 and to the first propellant unit 13 of the next carrier 7.

Figure 15:
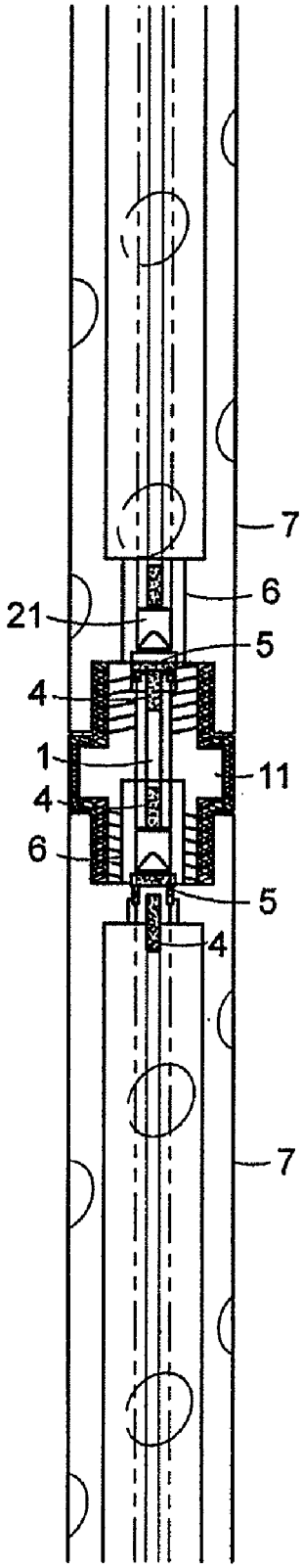
FIG. 15 illustrates the carrier connector's ability to connect multiple propellant carriers.

FIG. 15 illustrates how carrier connectors 11 can be used to connect multiple carriers 7 in a single, lengthy run. The carriers 7 can contain one or more propellant units 13. The explosive transfer unit 6 in the bottom propellant unit 13 of the upper carrier 7, when ignited, fires through its own bulkhead 19 and through the top end cap 5A of the carrier connector 11, into the detonating member 1 of the carrier (which optionally includes bi-directional booster 4), igniting detonating member 1, optionally igniting the next bi-directional booster 4, which ignites the explosive charge 21 of carrier, which fires through the top end cap 5 of the next propellant unit, igniting the detonating member 1 of the next propellant unit, and so on.

The invention includes a method of stimulating a well that includes providing a propellant unit, such as described above. The propellant unit can include a pre-stressed tube that is stressed a number of times to establish an initial gas pressure release from the propellant, e.g., to establish an initial pressure at a time of about 10 milliseconds after ignition of the propellant. The total amount of propellant utilized can be selected based upon the total amount of stimulation gas flow desired, e.g., to last for a duration of 500 milliseconds, or 1 second, and the like. This method provides for the independent control of at least two different variables—the amount of initial gas release (which can be controlled by the number and type of scoring used on the tube), plus the total amount of gas subsequently released (for immediate, subsequent propagation and stimulation in the multiple fracture regime). Control of these two variables results in a predetermined, controlled combustion of the propellant, maximizing the effectiveness of the stimulation for a given wellbore application. The one or more propellant units located within the one or more carriers are simultaneously ignited, e.g., using the type of firing train described above, thereby splitting the propellant in each propellant unit a predetermined number of times and establishing the amount of initial combustion gas flow that was previously determined. A gas pressure rise having a controlled, predetermined initial pressure rise, and a predetermined burn duration/amount can be generated by this technique.

Embodiments also include transferring an ignition from a first propellant unit to a second propellant unit using an explosive transfer cap 6. The propellant units are connected to the explosive transfer cap, the first propellant unit is ignited, e.g., using a detonator, the ignition is transferred from the first propellant unit to the explosive transfer cap, and an explosive charge (e.g., a shaped charge) within the explosive transfer cap then ignites a detonating member in the second propellant unit. An ignition can also be transferred from a first carrier unit to a second carrier unit including a propellant unit. Two carrier units are connected to a carrier connector 11 and an ignition from the first carrier is transferred through a top end cap seal 5A of the carrier to an explosive charge within the carrier. The resulting ignition within the carrier then passes through a seal, e.g., a bulkhead and to a firing train of a propellant unit 13 in a second carrier. Preferable, the ignition through the carrier propagates along a longitudinal axis of the carrier.

Yet another method includes a method of controlling a stimulating gas flow to a subterranean well that includes sizing the propellant charge to correspond to a total amount of stimulating gas desired, igniting the propellant cord using a detonating member within the propellant charge to split the charge a predetermined number of times. The number of splits in the propellant charge can be selected to correspond to the initial pressure rise desired in the well in which the propellant charge is ignited.

Embodiments of the invention also include various other methods. In general, the propellant unit is run (lowered) in a carrier tube that protects the propellant unit and has enough open flow area to allow the propellant gas to escape through the carrier without creating excessive pressure drop (gas flow resistance). The carrier can be made of steel and can be used multiple times because sufficient flow area is present to prevent creation of an excessive, damaging pressure differential when the propellant is consumed. The carrier assembly can be deployed into the wellbore in many different ways. For example, it can be conveyed by wireline, tubing, slickline, or coil tubing. As discussed above, FIG. 15 illustrates how multiple carriers can be connected to create a longer stimulation gun and firing train. The firing train can be used to ignite multiple sequential propellant units. The ability of the firing train to be continued through multiple propellant units (and carriers) allows for the propellant to be run in a single run on long intervals (e.g., 500 feet) by utilizing two or more carriers. The propellant units and propellant firing trains are somewhat flexible. As such, they can be used in wellbores having various configurations (e.g., vertical, horizontal, or other configurations).

The invention also includes a method for fracturing wells. Propellant units can be run into the well either alone or with a perforating gun (e.g., beneath a perforating gun). Fluid in the wellbore can be used to isolate the propellant gas (i.e., the combustion product). By the propellant gas compressing the well fluid above and below the propellant, the propellant-produced gas can be directed to the pay zone. The well fluid above the propellant carrier acts as a tamp. The propellant is ignited by a detonating member (e.g., a detonator), which can be ignited by a bidirectional booster. The booster can be ignited by a shaped charge, which can be ignited by a detonator or a primer cord. The gas generated from combustion of the propellant pressurizes the tamp fluid, creating a gas bubble which forces the gas into the pay zone. When the propellant is ignited by the detonating member (e.g., a directional linear charge) there is a rapid pressure rise due to ignition of the surface area of the propellant, which initiates multiple fractures and/or cleans up the well.

In some embodiments, the propellant is shielded from the wellbore fluids by dipping it into a solution that becomes a flexible covering when dry. The coating helps to preserve the useable energy content of the propellant, and to maintain predictability of the combustion and stimulation results. The flexibility of the coating allows for shrinking of the covering when it is subjected to hydrostatic pressure from the wellbore fluids. The protective covering is destroyed or blown off when the propellant is combusted, as any wellbore fluid is being blown away from the propellant. Destruction of the coating can occur as the propellant burns, as the critical pressure rise time that is needed to treat the well and/or to create multiple fractures is being achieved. Protection of the propellant from the wellbore fluids reduces or eliminates contamination of the propellant and results in a more consistent, predictable propellant burn, thereby yielding improved stimulation results.

The protective covering can be made of the same material as the propellant, but without the energetic portion (e.g., ammonium perchlorate) of the propellant mixture. The covering can also be made of a mixture in which the propellant can be dipped. In some embodiments, it can be brushed on to the propellant so that a dry thin coat of VITON® (registered trademark of DuPont Dow Elastomers, LLC) or rubbery coating material remains on the outside of the propellant sealing the propellant from the fluids and other elements in the well. In all of these embodiments, the propellant covering is consumed during the propellant burn so no covering remnants remain in the well. This prevents the coating from causing problems when the carrier is later recovered from the well.

In some embodiments a coating, e.g., a fluoroelastomer coating, does not readily adhere to the propellant unless a primer coating is used. Use of a primer coating can result in the satisfactory adhesion to the propellant of fluoroelastomer coatings such as KALREZ® (registered trademark of E.I. DuPont de Nemours and Company) and VITON. A suitable primer coating for this purpose can be manufactured as follows and should include: 5% Hytemp 4451 CG polyacrylate rubber (available from Zeon Chemicals of Louisville, Ky.), 5% DYNEON® FC-2178 fluoroelastomer (available from 3M, St. Paul, Minn.) and 1% titanium dioxide pigment in t-butyl acetate solvent. (DYNEON is a registered trademark of Dyneon LLC.) The following procedure can be used to formulate a suitable primer coating.

Step 1. Dissolve the Hytemp in t-butyl acetate to make a 5% solution of Hytemp in the solution.

Step 2. Separately cut up the FC-2178 into 1" chunks, and add enough t-butyl acetate to make a 20% solution of FC-2178 in t-butyl acetate.

Step 3. Mix the FC-2178 mixtures with a propeller-type stirrer in a closed container for about 8 hours, to dissolve all the FC-2178.

Step 4. Add enough of this thick FC-2178 solution to the Hytemp solution to have about 5% of each polymer. Then add 1% TiO2 pigment and stir the mixture for about an hour.

Step 5. Add 20 $cm^3$ of common wetting agent, such as "Smoothie II", which is commonly sold in automotive paint stores.

Step 6. Store the finished mixture in a sealed container. Store with caution as the mixture is flammable.

To administer the primer coating, either dip the propellant into the primer, or brush the primer onto the exterior of the propellant.

The barrier coating should be applied to the exterior of the primer coat after the primer has dried. The following procedure can be used to prepare the barrier coating.

Step 1. Mix solid FC-2178 at 74% with 25% mica powder, and 1% graphite. To mix, add 2270 grams of FC-2178, 568 grams of mica powder (e.g., HiMod 270 ground mica available from Oglebay Norton Company of Cleveland, Ohio), and 29 grams of dry, fine graphite plus 50 cc of wetting agent, plus t-butyl acetate to a total weight of 17912 grams. Dissolve the FC-2178 separately, as described above.

Step 2. Mix the mica, wetting agent and graphite in the remaining t-butyl acetate solvent.

Step 3. Add the thick 20% FC-2178 solution, which has been formulated as described above. This process keeps the mica and graphite from clumping. The finished product has 19.4-20.0% solids by weight.

Apply this coating to the primed propellant and allow the coating to dry. This barrier coating can be applied, e.g., by dipping or brushing. Moreover, in addition to Dyneon FC-2178, other fluoroelastomer materials, such as those available from Pelseal Technologies, LLC of Newtown, Pa., can be used.

While the invention has been particularly shown and described with reference to specific preferred embodiments, it should be understood by those skilled in the art that various changes in form and detail may be made therein without departing from the spirit and scope of the invention as defined by the following claims.

I claim:

1. A method of controlling stimulation gas flow to a producing or injection well comprising the steps of:

sizing a propellant charge of a propellant unit to correspond to a total desired stimulation gas volume to be generated;

igniting the propellant charge within the well using a detonating member disposed within the propellant unit, and splitting the propellant unit a number of times corresponding to the amount of initial gas pressure to be established, wherein the splitting is along a longitudinal axis of the propellant along about the length of the propellant.

2. A method of controlling stimulation gas flow to a producing or injection well comprising the steps of:

sizing a propellant charge of a propellant unit to correspond to a total desired stimulation gas volume to be generated;

igniting the propellant charge within the well using a detonating member disposed within the propellant unit, and splitting the propellant unit a number of times corresponding to the amount of initial gas pressure to be established, wherein the splitting is accomplished using a pre-stressed tube, the pre-stressed tube stressed by scoring along a length of the tube, the scoring including a shallow external groove established along the length of the tube.

3. A method of controlling stimulation gas flow to a producing or injection well comprising the steps of:

sizing a propellant charge of a propellant unit to correspond to a total desired stimulation gas volume to be generated;

igniting the propellant charge within the well using a detonating member disposed within the propellant unit, and splitting the propellant unit a number of times corresponding to the amount of initial gas pressure to be established, the method further comprising using a plurality of propellant charges, the ignition transferred from one propellant charge to another propellant charge using an explosive transfer cap.

4. The method of claim 3 wherein the explosive transfer cap comprises:

a housing including a first seal and a second seal having a longitudinal axis extending therethrough; and an explosive charge between the first seal and the second seal to facilitate ignition along the longitudinal axis, wherein the explosive charge is a shaped charge.

5. The method of claim 4 wherein the explosive charge of the explosive transfer cap is configured to be ignited by a detonator.

6. The method of claim 4 wherein the first seal and the second seal are aligned along a longitudinal axis of the explosive transfer cap and the explosive charge facilitates ignition along the longitudinal axis.

7. The method of claim 6 wherein the first seal is a double seal including two sealing mechanism.

8. The method of claim 7 wherein the second seal is a plug.

* * * * *